US006341484B2

(12) United States Patent
Dinkelmann et al.

(10) Patent No.: US 6,341,484 B2
(45) Date of Patent: Jan. 29, 2002

(54) DRAFTING FRAME FOR A SPINNING MACHINE

(75) Inventors: Friedrich Dinkelmann, Rechberghausen; Andreas Olbrich, Kirchheim; Peter Artzt; Günter Steinbach, both of Reutlingen, all of (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

(21) Appl. No.: 09/792,289

(22) Filed: Feb. 23, 2001

(30) Foreign Application Priority Data

Feb. 24, 2000 (DE) ..... 100 08 610

(51) Int. Cl.[7] ..... D01H 13/04
(52) U.S. Cl. ..... 57/315; 19/244; 19/246
(58) Field of Search ..... 19/150, 236–250, 19/252, 263, 286–288, 304–308; 57/264, 304, 315, 328, 333

(56) References Cited

U.S. PATENT DOCUMENTS 5,600,872 A * 2/1997 Artzt et al. ..... 19/244
6,052,872 A * 4/2000 Lang et al. ..... 19/288
6,073,314 A * 6/2000 Barauke ..... 19/246
6,131,382 A * 10/2000 Dinkelmann et al. ..... 57/315
6,134,872 A * 10/2000 Olbrich ..... 57/264
6,158,091 A * 12/2000 Olbrich et al. ..... 19/263
6,189,308 B1 * 2/2001 Dinkelmann et al. ..... 57/315
6,202,398 B1 * 3/2001 Dinkelmann et al. ..... 57/315

FOREIGN PATENT DOCUMENTS

| | | |
|---|---|---|
| DE | 44 26 278 | 2/1996 |
| DE | 195 47 462 | 6/1997 |
| DE | 197 26 694 | 4/1998 |
| DE | 198 15 325 | 10/1999 |

* cited by examiner

*Primary Examiner*—John J. Calvert
*Assistant Examiner*—Gary L. Welch
(74) *Attorney, Agent, or Firm*—Herbert Dubno

(57) ABSTRACT

A sliver compactor is provided between a drafting roller of a drafting frame and the delivery unit which supplies the sliver to the spinning stations of the spinning machine. The sliver compactor has a shielding element juxtaposed with the perforated moving surface to which suction is applied and which reduces the suction force required to draw the fibers of the sliver into a compact form. The shielding element extends over a plurality of slivers and the respective spinning stations and a number of such shielding elements may be aligned over the length of the machine below the stretching field plane and secured on the machine frame.

9 Claims, 5 Drawing Sheets

DRAFTING FRAME FOR A SPINNING MACHINE

SPECIFICATION

1. Field of the Invention

Our present invention relates to a drafting frame for a spinning machine, and, more particularly, to a drafting frame having a pneumatic compactor for the sliver or roving.

2. Background of the Invention

A spinning machine is usually provided with a drafting frame having upper and lower rollers and through which the sliver or roving passes, the upper rollers being weighted against the sliver. The lower rollers may extend over numerous sliver paths, each of which delivers the sliver to a respective spindle of the spinning machine while the upper roller may be limited to the respective paths and it is not uncommon for each weighting arm to carry the upper drafting rollers for two such paths or spindles.

It is known to provide a pneumatic compacting device for each drafting path of such a drafting frame (see DE 198 15 325) by disposing between the drafting frame and the wind-up device with its twist-defining location, a perforated compaction element below a shield. Suction is applied to the row of perforations on this element to draw the fibers of the roving inwardly toward the roving center and thereby compact the roving before it receives a twist and is wound on a bobbin.

In this construction, the output lower roller of the drafting frame may be formed as a perforated roller and the shield with which it is juxtaposed lies above the perforated roller and has an air-guiding function so that the incoming air, drawn out through the suction opening acts from both sides of the sliver and thereby improves the yarn quality. The spacing of the shield from the lower suction roller must be adjusted at each spinning station individually and, since the shield is provided on the weighting arm, generally the mobility of the weighting arm must be also controlled. These requirements contribute to a time-consuming setup of the apparatus, require frequent readjustments and create conditions whereby, if careful adjustments are not made, the quality of the yarn may be adversely affected.

OBJECTS OF THE INVENTION

It is the principal object of the present invention to provide a drafting frame with a pneumatic compactor, i.e. a device which tends to draw, by suction, fibers of a sliver inwardly toward the center thereof, whereby drawbacks of earlier systems are avoided.

Another object of this invention is to provide a drafting frame for a spinning machine in which the need for adjustment and resetting of parts of the pneumatic compaction unit are minimized, wherein the energy consumption for generating the suction is optimized and the servicing of the drafting frame is facilitated.

Another object of this invention is to optimize the suction air flow in a sliver compactor for a drafting frame of a spinning machine.

SUMMARY OF THE INVENTION

These objects and others which will become apparent hereinafter are attained, in accordance with the present invention by providing the shield element as a continuous elongated profile or shield segment extending over a multiplicity of spinning stations below the drafting field plane and mounted on the machine frame. Of course, the shield itself can be one of a plurality of aligned segments as long as each segment extends over a multiplicity of spinning stations, i.e. at least four and all are mounted on the machine frame below the perforated element. Each shield element or segment can thus extend over 4, 6, 8, 10 or 12 spinning stations and hence sliver paths, each of which can be provided with its own perforated member to which suction is applied on the side thereof opposite that at which the perforated member engages the sliver. The perforated member is usually a belt but can be a roller and the suction hood communicating with the perforations along the periphery of the member can extend over at least the width of the shield element. According to a feature of the invention, the shield element is of continuous elongated profile of uniform cross section, i.e. a structural shape, with a T or V shaped cross section or can be of a polygonal cross section and is advantageously mounted below the stitching field plane. This system permits the shield element to cover large areas without restricting the servicing of the drafting frame.

The ends of the profile can be received in rails or frame members forming supports for the drafting frame and particularly at the bearings and the lower rollers of the drafting frame. The bearing mounts can be provided with recesses in which the profile members or shields can be seated from above so that absolutely no adjustment of the shield elements is required. Their positions can be fixed for all spinning stations in each section of the machine over which the particular shield segment extends.

According to another feature of the invention the surface of the shield juxtaposed with the surface formed with the suction opening or openings can conform to the contour of the transport surface, i.e. the surface along which the sliver is entrained. In the case of a convex contour of the transport surface, the juxtaposed surface of the shield will be concave, for example.

According to another aspect of the invention, the shield can be mounted directly on the suction device.

The shield element can be provided with a resilient tongue which can retain the shield in a closed position and can at least partly close the space in which the sliver is guided and which is defined between the shield and the transport surface with its perforation. For ease in threading the sliver into this space, the tongue can be pressed downwardly to allow the sliver to be inserted. The fact that the shield can be deflected can also facilitate replacement of the transport surface, e.g. a perforated belt. Since the shield element is elastic, it can be opened by pressure of the sliver or yarn thereof when, for example, the tension is applied to the strand and can then close automatically after the strand has been inserted or removed. The spring system can be the intrinsic elasticity of the large-area shielding element itself.

In both constructions in accordance with the invention, the suction flow around the yarn can be optimized by the air guiding characteristics of the large-area shield element and the energy requirements for generating the suction can be reduced. The serviceability of the drafting frame, especially in threading the sliver through the frame at the start-up of spinning and in cleaning of the drafting frame, is not hindered by the system of the invention.

The drafting frame according to the first aspect of the invention thus comprises:

a drafting zone comprising a roller support, and a plurality of roller pairs successively traversed by respective slivers for delivery to respective spinning stations whereby each sliver is drafted in a drafting field plane between successive roller pairs, the drafting zone having at least one output roller;

a feed unit on the support spaced from the output roller and supplying each sliver to the respective spinning station;

a transporter between the output roller and the feed unit and formed with a moving transport surface having at least one perforation assigned to each sliver and traveling across a suction opening applying suction to the respective sliver to compact the sliver; and an elongated shielding element juxtaposed with the surface over an effective region of the suction opening and extending longitudinally over a plurality of spinning stations while being affixed to the support below the drafting field plane.

In accordance with a second aspect of the invention the drafting frame can comprise:

a drafting zone comprising a roller support, and a plurality of roller pairs successively traversed by respective slivers for delivery to respective spinning stations whereby each sliver is drafted in a drafting field plane between successive roller pairs, the drafting zone having at least one output roller;

a feed unit on the support spaced from the output roller and supplying each sliver to the respective spinning station;

a suction unit forming a sliver compactor between the output roller and the feed unit and comprising a moving transport surface having at least one perforation assigned to each sliver and traveling across a suction opening applying suction to the respective sliver to compact the sliver; and a large-area shielding element juxtaposed with the surface and affixed directly to the suction unit.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
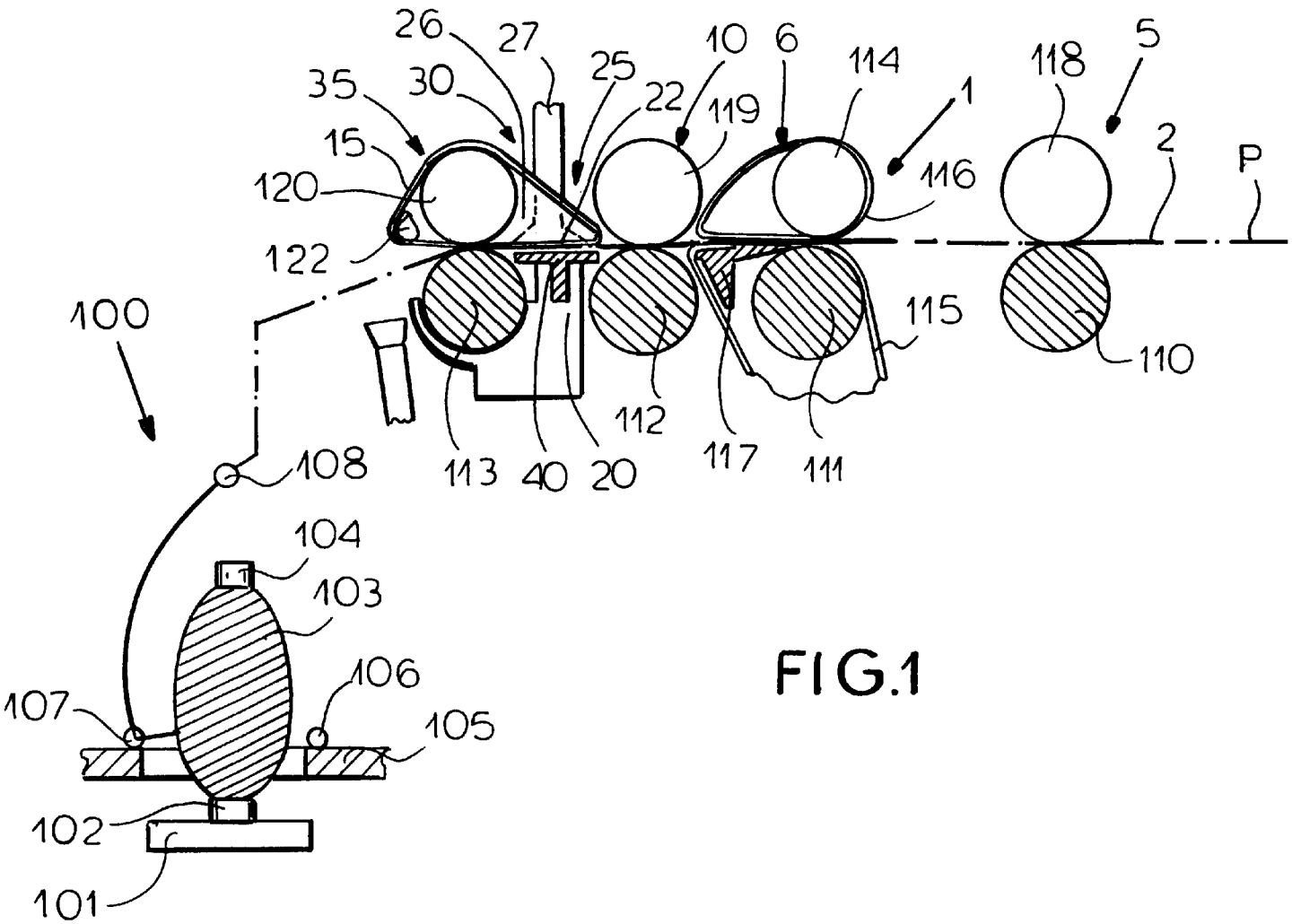
FIG. 1 is a transverse vertical section through a drafting frame according to the invention in which the shield element is a rail of T cross section.

FIG. 1 shows a drafting frame 1 for a spinning machine 100 in which the spinning stations are represented by a spindle rail 101 which carries the spindles 102 on which bobbins 103 can be wound on respective tubes 104. In the machine illustrated, the spinning stations are ring-spinning stations and thus a vertically movable ring rail 105 carries the traveler ring 106 surrounding each bobbin and on which the traveler 107 orbits. The twist is formed at the thread guide eye 108 for each of the slivers 2 and, while a single spinning station has been shown in FIG. 1, it will be understood that such stations are spaced apart along the machine perpendicular to the plane of the paper in FIG. 1 and each sliver 2 is delivered to a respective spinning station to be twisted and wound in the respective bobbin.

Figure 4:
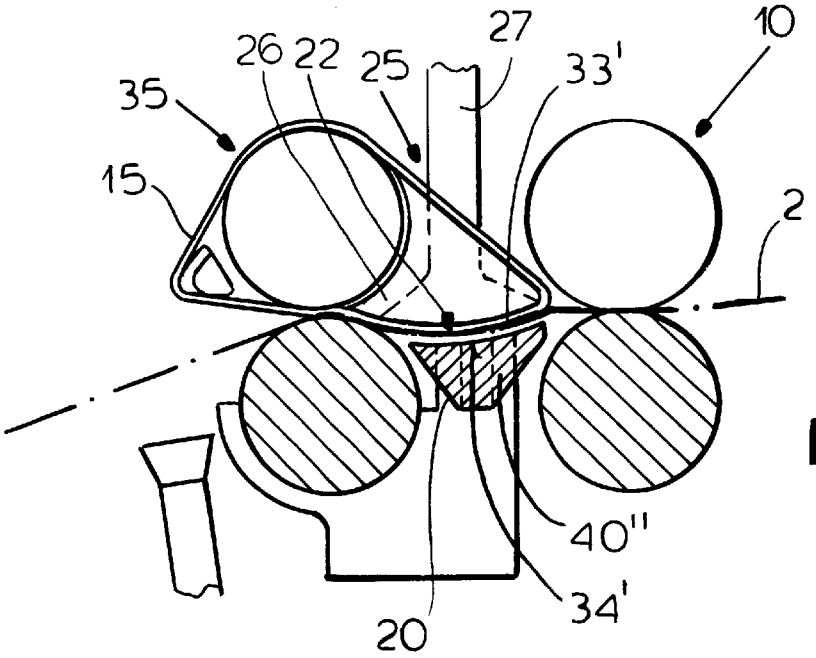
FIG. 4 is a view similar to FIG. 3 in an embodiment in which the contours of the shielding element and the surface of the perforated element conform in shape.
Figure 4A:
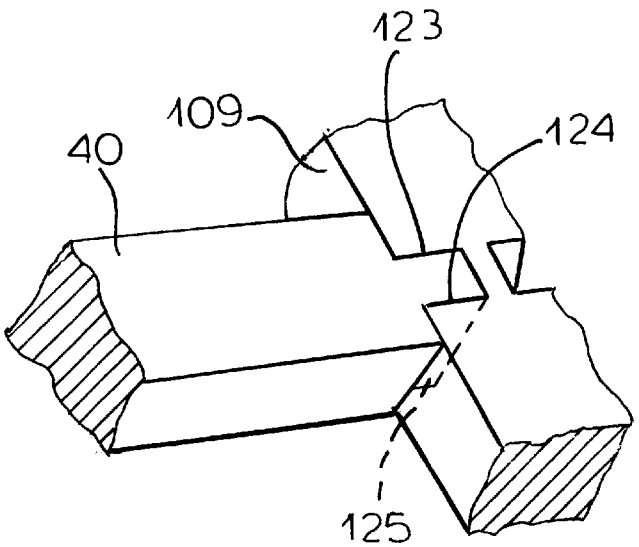
FIG. 4A is a detail showing how a bar or rail forming the shield can be supported in a frame or chassis member of the drafting frame.

The drafting frame 1 has a machine framework represented at 20 in FIG. 1 and, in part, by the frame member 109 in FIG. 4A, in which the lower rollers 110, 111, 112, 113 of the drafting frame are mounted. Basically the drafting frame can have a first roller pair 5 and a second roller pair 6 is among other roller pairs, if desired, and an output roller pair 10 can follow the second roller pair 6. The main stretching or drafting of the sliver 2 takes place between the second roller pair 6 and the output roller pair 10 and in a drafting plane P. The rollers 111 and 114 of the roller pair 6 can be provided with belts 115, 116, the latter being guided over a bar 117 also fixed to the machine frame.

Figure 2:
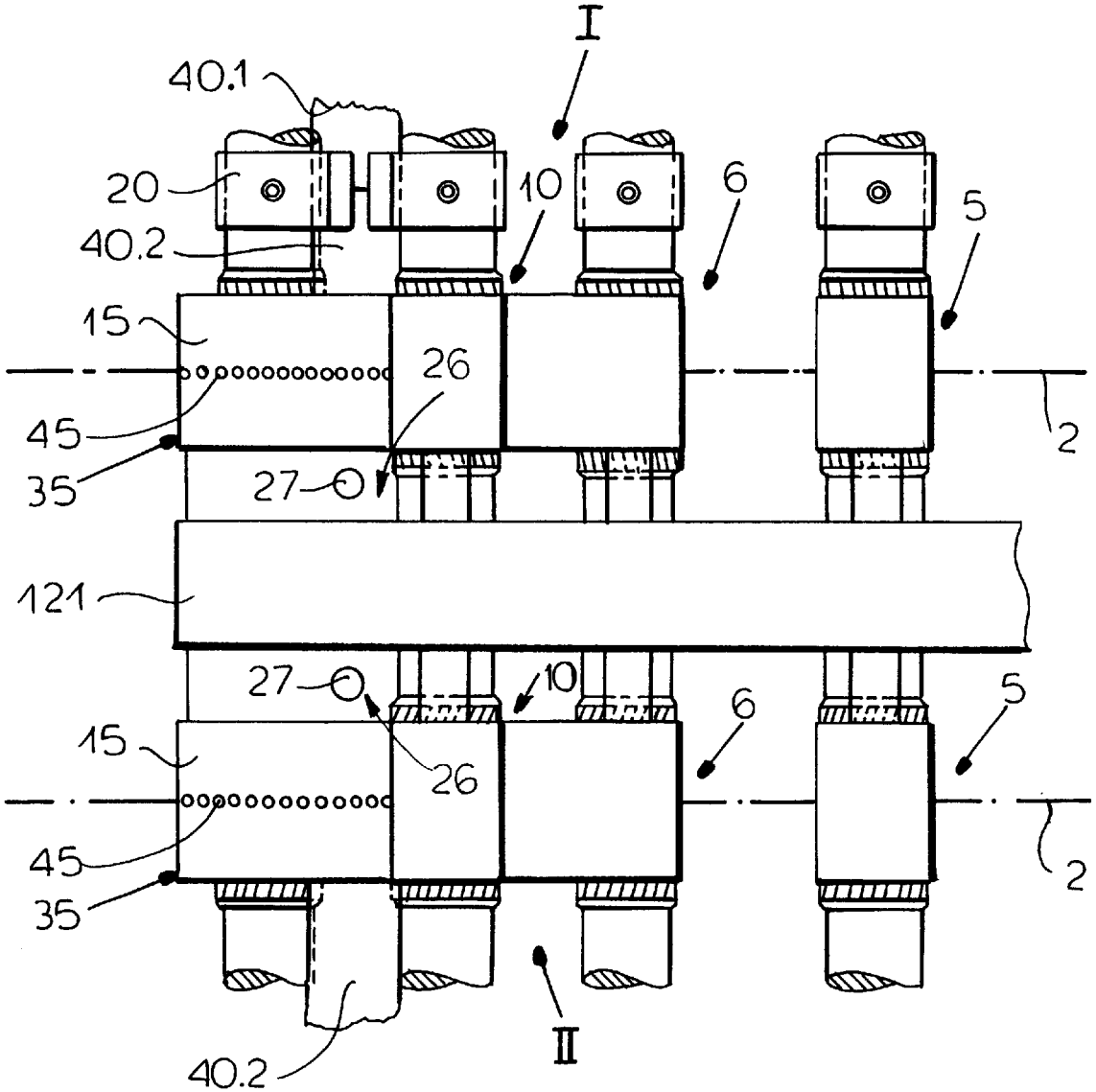
FIG. 2 is a plan view of the drafting frame of FIG. 1.

As can be seen from FIG. 2, the upper rollers 118 of the roller pair 5, the roller 114 of the roller pair 6, the roller 119 of the roller pair 10 and the roller 120 to be described are carried by a weighting arm 121. Each weighting arm 121 serves two slivers 2 (see FIG. 2) and thus carries two rollers 114 and 118–120, each forming a member of a respective roller pair as described. The weighting arms 121 of the spinning machine are lifted to permit the sliver to be threaded through the drafting frame.

Immediately following the output roller pair 10 is a pneumatic compaction device 30 which will be described in greater detail below. Pneumatic compaction devices serve to apply suction to the sliver along a line which is narrower than the sliver to thereby draw laterally-projecting fibers inwardly and render the sliver strand more compact. The pneumatic compactor 30, in turn, is followed by a feeder unit 35 of which the aforementioned roller 120 is a part and which supplies the compacted drafted sliver to the twisting and winding-up unit, namely, the spinning station. The regions between the output roller pair 10 and the feed unit 35 thus forms a fiber bundling zone. In this zone the strand of sliver is subjected to a suction air stream which is drawn in transversely to the travel direction of the sliver and thus compacts the same. In this zone the sliver is engaged by a transport circuit formed, in the embodiments shown by a belt 15 provided with a row of orifices 45 in a line (FIG. 2) and referred to here as the linear perforation of the transport medium 15.

The pneumatic compactor also comprises a suction opening 22 formed by a suction device 25 and along which the belt 15 rides on the opposite side of the belt from that which engages the sliver between the output roller pair 10 and the feed unit 35. The opening 22 is formed in a suction shoe which thus rides on the belt. The belt 15 also passes around the guide 122. The shoe communicates via the opening 22 with the orifices 45. The suction shoe 26 is connected with a suction line 27 which can, in turn, be connected to a suction source not shown, namely, a suction pump. Over the effective width of the suction opening 22 and juxtaposed with the belt 15, a shielding element 40 is arranged to restrict the air flow into the narrow gap between the belt and the shielding element and through which the sliver 2 is guided.

In the embodiment illustrated in FIGS. 1 and 2 the shielding element 40 is a continuous bar which has a T shaped cross section. It extends over a plurality of spinning stations and thus over a number of slivers 2. Such stations are represented at I and II in FIG. 2. The bar 40 lies below the stretching field plane P and is mounted on the machine frame 20, 109. In FIG. 4A, for example, the bar is shown to have a tongue 123 which engages in a notch 124 of the frame member 109 and rests on a surface 125 at the bottom of that notch.

Preferably a number of the bars 40 are disposed end to end along each side of the spinning machine and each bar extends over four or more spinning stations.

Figure 3:
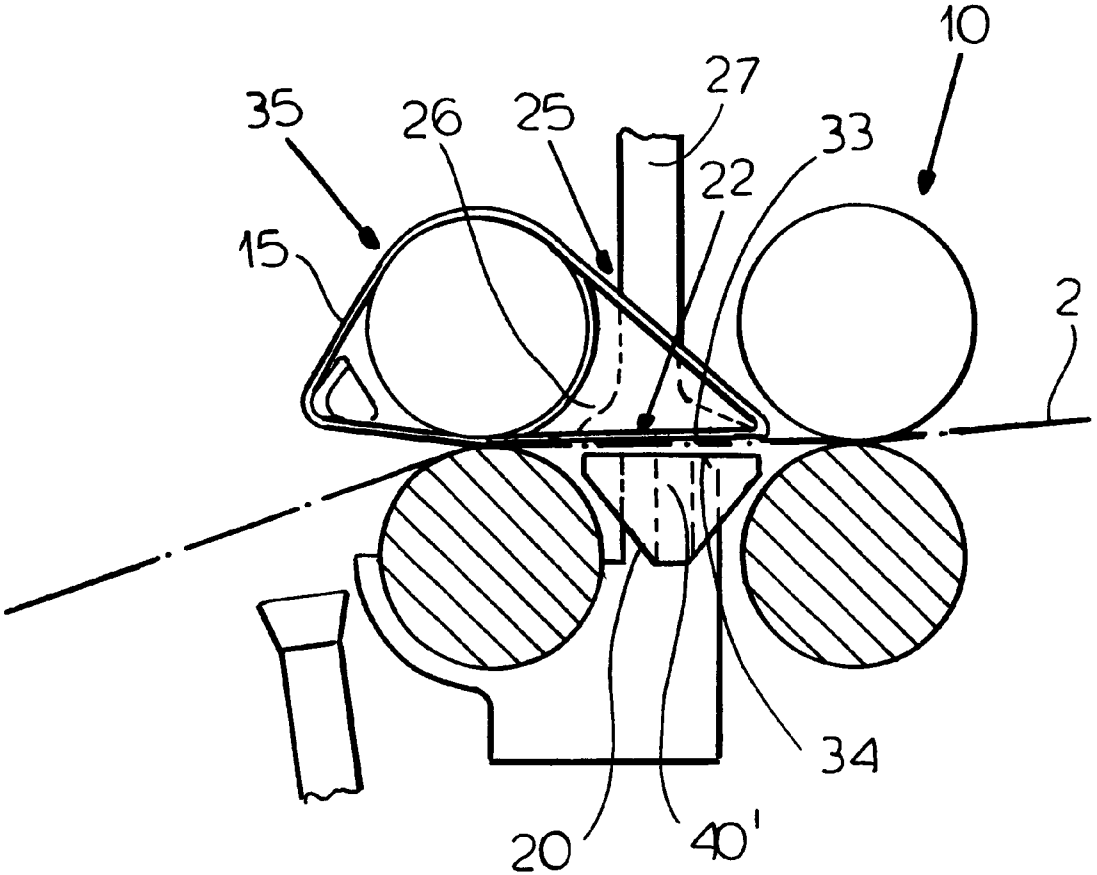
FIG. 3 is a cross sectional view through the last two rollers of a drafting frame in accordance with another embodiment of the invention.

From FIG. 2 it can be seen that the ends 40.1 and 40.2 of two bars are supported and the bearing mount 20 for the lower rollers 110, 111, 112, 113 of the drafting frame and forming part of the machine frame or support. In this embodiment, the bearing mounts 20 can have cutouts or rests which are shaped to accommodate the ends of the bars 40, i.e. the profile forming the shielding elements, so that the latter can be laid into the bearing mounts 20 from above. As a consequence no additional adjustment effort is required for positioning the shielding bars and the positions thereof for all spinning stations in a section can be fixed. The embodiment of FIG. 3 is similar to that of FIGS. 1 and 2 except that the shielding element of 40' has a V shape in cross section. The bearing mount 20 is correspondingly formed to allow the shielding element 40' to be dropped into it from above and to be securely held therein. The shielding element can have any other polygonal cross section desired and indeed the surface 34 juxtaposed with the surface 33 of the belt 15 engaging the sliver 2 should be contoured to match that of the surface 33' along which the sliver is displaced. This has been shown in FIG. 4 where the surface 34' is concave on the shielding element or bar 40".

Figure 5:
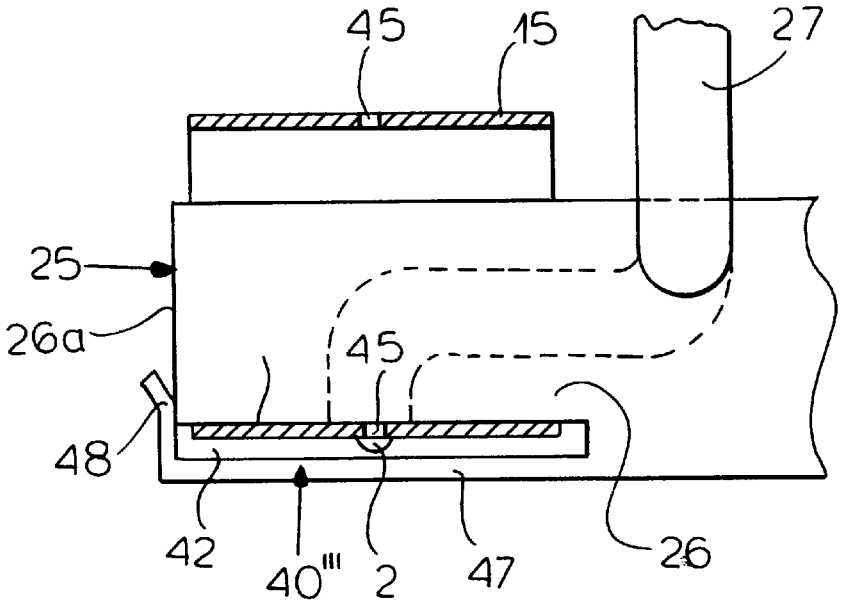
FIG. 5 is a cross sectional view in diagrammatic form of a suction device with a flexible shield element seen from the output side of the drafting frame, according to another embodiment of the invention in the closed position.
Figure 6:
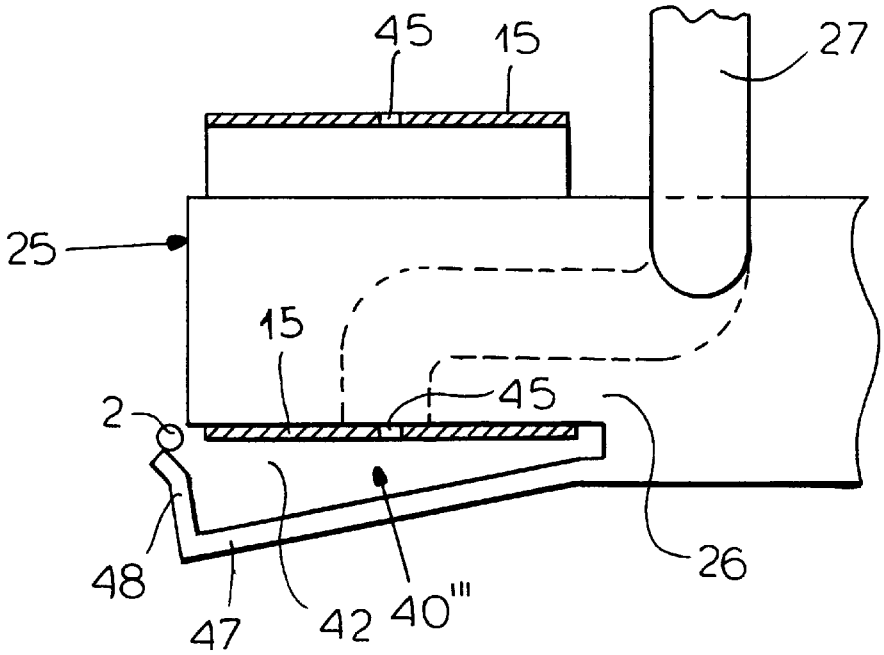
FIG. 6 is a view similar to FIG. 5 showing the position of the shield before start-up.

FIGS. 5 and 6 illustrate another embodiment of the invention wherein the large area shielding element 40'" is affixed directly on the suction unit 25. FIG. 5 shows the shielding element 40'" in its closed position, i.e. the sliver 2 is received in a downwardly openable recess or region 42 of the suction unit 25. This region 42 is covered by a spring tongue 47 resiliently connected to the body of the shoe 26 and forming the shielding element. At one end the tongue 47 is formed with a closing rib 48 which can close off the region 42 to the exterior and can resiliently engage a flank 26*a* of the shoe 26.

Since the tongue 47 can be bent resiliently downwardly (FIG. 6) it is easy to thread the sliver 2 into the space 42 prior to startup of the spinning operation or to remove the belt 15 for replacement. The insertion of the sliver can be achieved by hand or, by tension on the sliver 2, the latter can bend the tongue 47 open. Because of the spring action the tongue 47 closes automatically to return from the position 6 into the position of FIG. 5.

The large area shielding elements 40, 40', 40", 40'" optimally direct the suction air flow around the sliver so that the energy demand for generating the suction is reduced. Nevertheless the surface of the drafting frame and especially the insertion of the sliver and cleaning of the system is not restricted. The expense and time-consuming adjustment of the shielding element is reduced.

We claim:

1. A drafting frame for a spinning machine comprising:

a drafting zone comprising a roller support, and a plurality of roller pairs successively traversed by respective slivers for delivery to respective spinning stations whereby each sliver is drafted in a drafting field plane between successive roller pairs, said drafting zone having at least one output roller;

a feed unit on said support spaced from the output roller and supplying each sliver to the respective spinning station;

a suction unit forming a sliver compactor between said output roller and said feed unit and comprising a moving transport surface having at least one perforation assigned to each sliver and traveling across a suction opening applying suction to the respective sliver to compact the sliver; and a shielding element juxtaposed with said surface and defining with said surface in said suction unit a space openable toward the exterior and into which said sliver is insertable, said perforation being formed by a row of orifices in said moving transport surface riding across a shoe having said suction opening formed therein, said shielding element being integral with said shoe at one end and being formed with a resilient flange at an opposite end, said flange being deflectable by said sliver to open said space and engageable with a portion of said shoe to close said space.

2. A drafting frame for a spinning machine comprising:

a drafting zone comprising a roller support, and a plurality of roller pairs successively traversed by respective slivers for delivery to respective spinning stations whereby each sliver is drafted in a drafting field plane between successive roller pairs, said drafting zone having at least one output roller;

a feed unit on said support spaced from the output roller and supplying each sliver to the respective spinning station;

a suction unit forming a sliver compactor between said output roller and said feed unit and comprising a moving transport surface having at least one perforation assigned to each sliver and traveling across a suction opening applying suction to the respective sliver to compact the sliver; and a large-area shielding element juxtaposed with said surface and affixed directly to said suction unit, said shielding element having an outwardly open region formed with a spring tongue for closing said region.

3. The drafting frame defined in claim 2 wherein said spring tongue has a closing profile which covers said region toward the exterior.

4. A drafting frame for a spinning machine comprising:

a drafting zone comprising a roller support, and a plurality of roller pairs successively traversed by respective slivers for delivery to respective spinning stations whereby each sliver is drafted in a drafting field plane between successive roller pairs, said drafting zone having at least one output roller;

a feed unit on said support spaced from the output roller and supplying each sliver to the respective spinning station;

a transporter between said output roller and said feed unit and formed with a moving transport surface having at least one perforation assigned to each sliver and traveling across a suction opening applying suction to the respective sliver to compact the sliver; and an elongated shielding element in the form of a bar surface over an effective region of said suction opening and extending longitudinally over a plurality of spinning stations while being affixed to said support below the drafting field plane, said shielding element having ends mounted in bearing supports for lower rollers of said roller pairs.

5. The drafting frame defined in claim 4 wherein said roller supports each is formed with a configuration complementary to and receiving the respective end of the shielding element.

6. The drafting frame defined in claim 4 wherein said shielding elements have cross sections selected from a T-shaped cross section, a V-shaped cross section and a polygonal cross section.

7. The drafting frame defined in claim 6 wherein said contoured and said shielding element has a face juxtaposed with said surface of a complementary contour.

8. The drafting frame defined in claim 7 wherein said surface is of convex contour and said face is concave.

9. The drafting frame defined in claim 4 wherein a plurality of said shielding elements are aligned in said spinning machine with each of said shielding elements extending over at least four of said spinning stations.

* * * * *